US010761465B2

(12) United States Patent
Yabuki et al.

(10) Patent No.: US 10,761,465 B2
(45) Date of Patent: Sep. 1, 2020

(54) FUSER DEVICE HAVING BELT SUPPORTING PART AND IMAGE FORMING APPARATUS HAVING THE SAME

(71) Applicant: Oki Data Corporation, Tokyo (JP)

(72) Inventors: Ryoji Yabuki, Tokyo (JP); Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/445,245

(22) Filed: Jun. 19, 2019

(65) Prior Publication Data

US 2020/0004183 A1 Jan. 2, 2020

(30) Foreign Application Priority Data

Jun. 28, 2018 (JP) ..... 2018-123037

(51) Int. Cl.
*G03G 15/20* (2006.01)

(52) U.S. Cl.
CPC ..... *G03G 15/2053* (2013.01); *G03G 2215/00151* (2013.01); *G03G 2215/2016* (2013.01)

(58) Field of Classification Search
CPC ..... G03G 15/2053; G03G 15/1615; G03G 2215/00151; G03G 2215/1623; G03G 2215/2016; B65G 15/60; B65G 39/16
USPC ..... 399/165, 329, 302, 303, 312; 474/151, 474/158; 198/840
See application file for complete search history.

(56) References Cited

U.S. PATENT DOCUMENTS

| | | | | |
|---|---|---|---|---|
| 9,164,445 | B2 * | 10/2015 | Shimokawa | G03G 15/2053 |
| 9,405,250 | B2 * | 8/2016 | Ogawa | G03G 15/2028 |
| 9,811,031 | B2 * | 11/2017 | Kawata | G03G 15/2053 |
| 2013/0045032 | A1 * | 2/2013 | Shimokawa | G03G 15/2053 399/329 |
| 2015/0043953 | A1 * | 2/2015 | Nakamoto | G03G 15/2025 399/329 |
| 2016/0132009 | A1 * | 5/2016 | Yashiro | G03G 21/1647 399/329 |
| 2016/0274511 | A1 * | 9/2016 | Ogino | G03G 15/2053 |
| 2016/0363896 | A1 * | 12/2016 | Hayashi | G03G 15/2057 |
| 2017/0017183 | A1 * | 1/2017 | Kawaguchi | G03G 15/2053 |

FOREIGN PATENT DOCUMENTS

| | | | |
|---|---|---|---|
| JP | 2006065250 A | * | 3/2006 |
| JP | 2009237186 A | * | 10/2009 |
| JP | 2017-203873 A | | 11/2017 |

* cited by examiner

*Primary Examiner* — Robert B Beatty
(74) *Attorney, Agent, or Firm* — Muncy, Geissler, Olds & Lowe, P.C.

(57) ABSTRACT

A fuser device for fusing a developer image on a medium by applying heat includes an endless fuser belt, a belt supporting part that has a contact face shaped in an arc centering on a first central axis and contacts with the inner circumferential face of the fuser belt on the contact face, a driven ring that is disposed on at least one side of the fuser belt in the width direction of the fuser belt, and a ring supporting part that has a contact face shaped in an arc centering on a second central axis and contacts with an inner circumferential face of the driven ring on the contact face, wherein the first central axis is shifted from the second central axis.

16 Claims, 14 Drawing Sheets

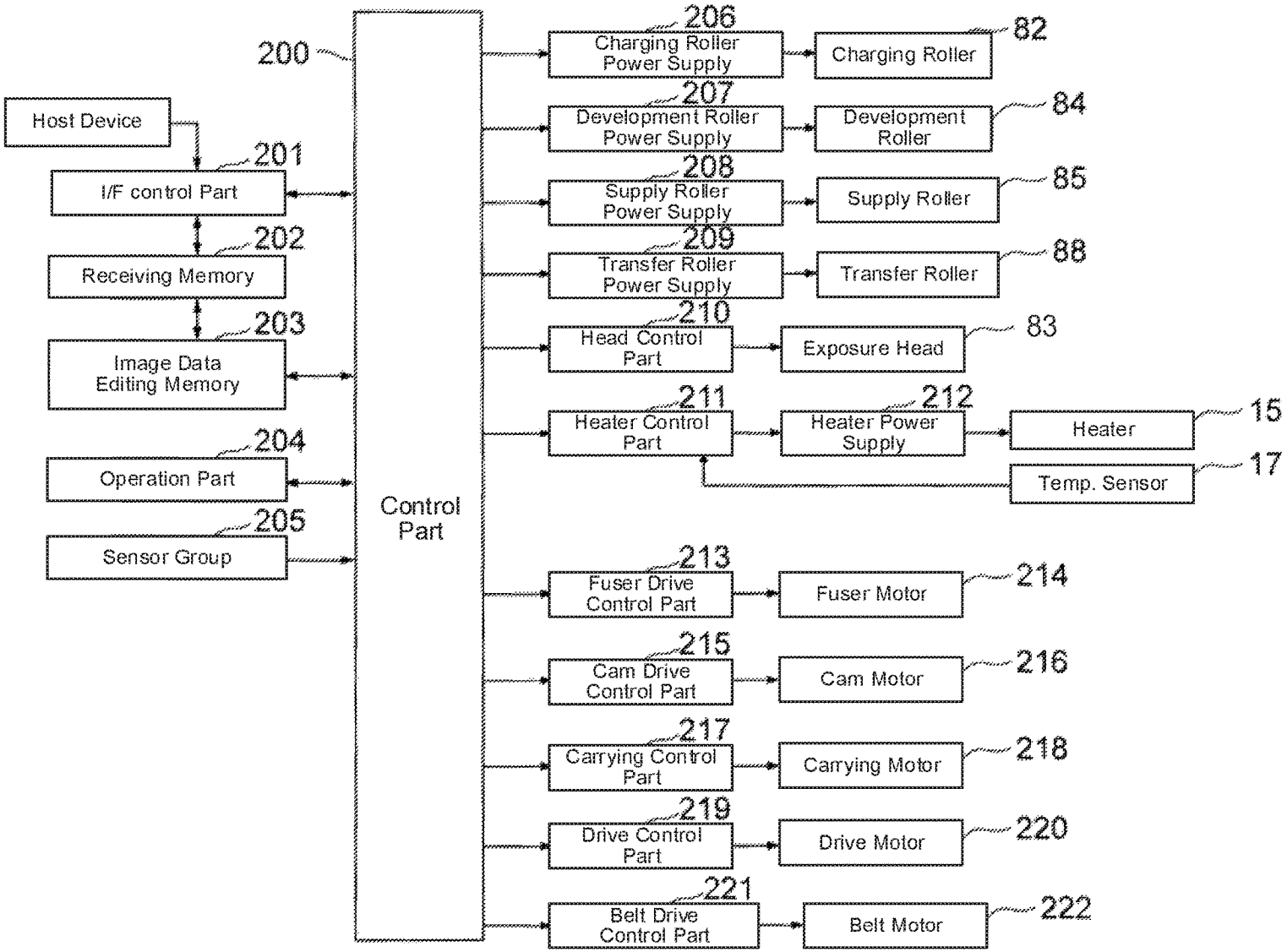
Fig. 10
200
Control Part
Host Device
201
I/F control Part
202
Receiving Memory
203
Image Data Editing Memory
204
Operation Part
205
Sensor Group
206
Charging Roller Power Supply
207
Development Roller Power Supply
208
Supply Roller Power Supply
209
Transfer Roller Power Supply
210
Head Control Part
211
Heater Control Part
212
Heater Power Supply
213
Fuser Drive Control Part
214
Fuser Motor
215
Cam Drive Control Part
216
Cam Motor
217
Carrying Control Part
218
Carrying Motor
219
Drive Control Part
220
Drive Motor
221
Belt Drive Control Part
222
Belt Motor
82
Charging Roller
84
Development Roller
85
Supply Roller
88
Transfer Roller
83
Exposure Head
15
Heater
17
Temp. Sensor

FUSER DEVICE HAVING BELT SUPPORTING PART AND IMAGE FORMING APPARATUS HAVING THE SAME

TECHNICAL FIELD

This invention relates to a fuser device that fuses an image to a medium, and an image forming apparatus provided with the fuser device.

BACKGROUND

A fuser device used in an electrophotographic image forming apparatus may use an endless fuser belt. Disclosed in Patent Document 1 is a fuser device that rotatably holds a fuser belt by a flange-shaped holding member installed on the inner circumferential side of the fuser belt. Also, in order to regulate the width-direction displacement of the fuser belt, driven ring are disposed on both sides in the width direction of the fuser belt. The driven rings contact with the width-direction ends of the fuser belt and rotate following the fuser belt.

RELATED ART

[Patent Doc. 1] JP Laid-Open Patent Application Publication 2017-203873

However, because a rotational speed difference can easily occur between the fuser belt and the driven rings, a groove may be formed on the surface of the driven rings due to friction. If the groove on the driven rings becomes deep, it can lead to a damage to the fuser belt.

This invention has been made in order to solve the above-mentioned problem, and its objective is to prevent damages to the fuser belt and the driven rings.

SUMMARY

A fuser device, which is disclosed in the application, for fusing a developer image on a medium by applying heat includes an endless fuser belt, a belt supporting part that has a contact face shaped in an arc centering on a first central axis and contacts with the inner circumferential face of the fuser belt on the contact face, a driven ring that is disposed on at least one side of the fuser belt in the width direction of the fuser belt, and a ring supporting part that has a contact face shaped in an arc centering on a second central axis and contacts with an inner circumferential face of the driven ring on the contact face, wherein the first central axis is shifted from the second central axis.

An image forming apparatus, disclosed in the application, includes an image forming part that forms a developer image on a medium, and the fuser device described above that fuses the developer image formed by the image forming part to the medium.

According to this invention, because a first central axis and a second central axis are displaced, the fuser belt is prevented from continuing to contact with the same radial position of the driven rings, and as a result it becomes hard for a groove to be formed on the driven rings. Also, by a groove becoming difficult to be formed, a damage to the fuser belt is also prevented.

BRIEF DESCRIPTIONS OF THE DRAWINGS

Figure 6A:
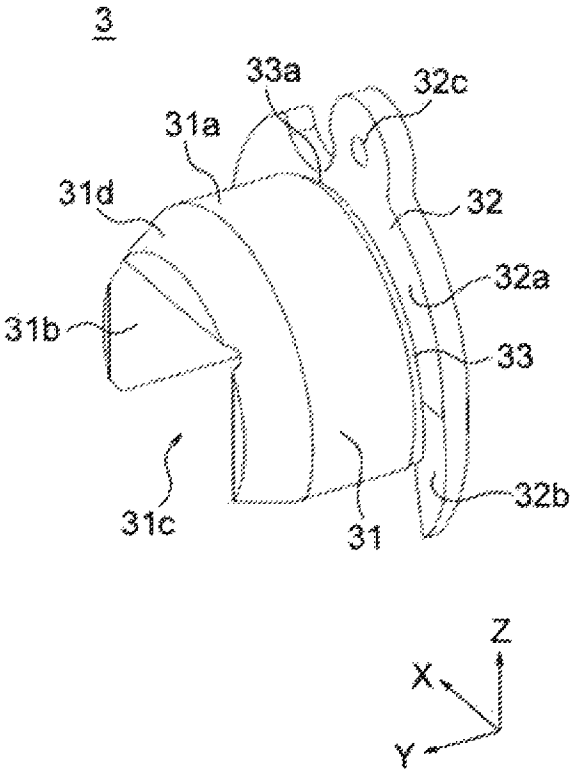
Figure 6B:
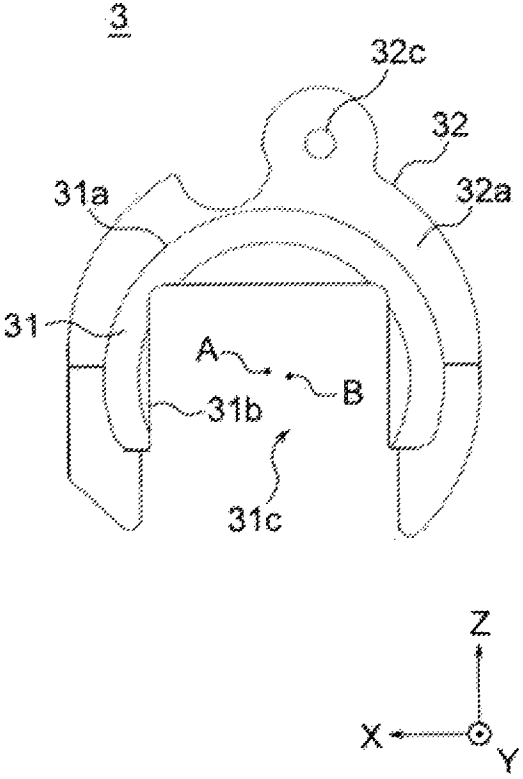
Figure 6C:
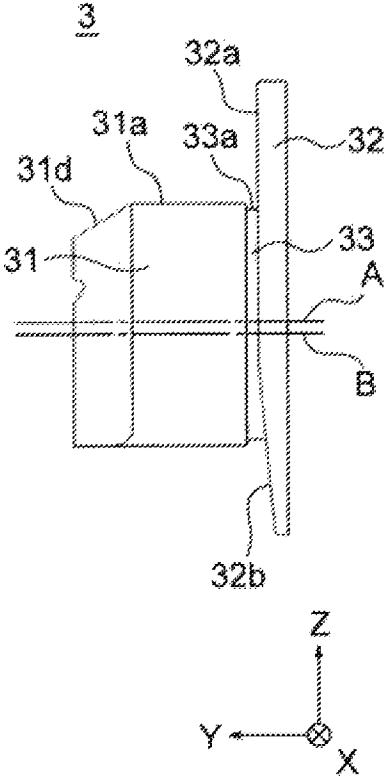

FIGS. 6A-6C respectively show a perspective view, a front view, and a side view showing a flange member (supporting body) of the embodiment.

Figure 7:
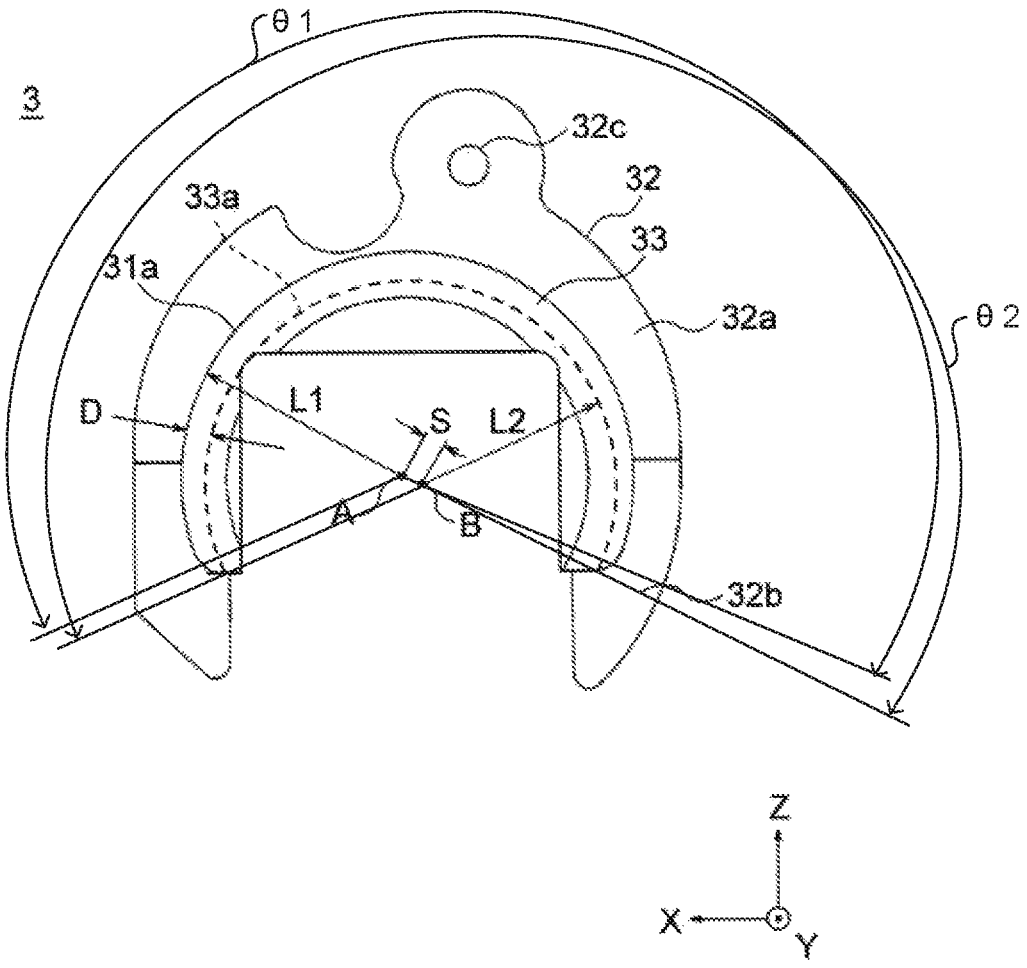

FIG. 7 is a schematic diagram for explaining the depth of a groove part of the flange member of the embodiment.

Figure 8A:
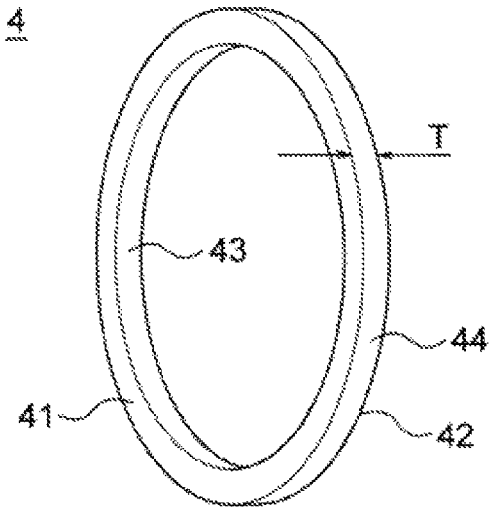
Figure 8B:
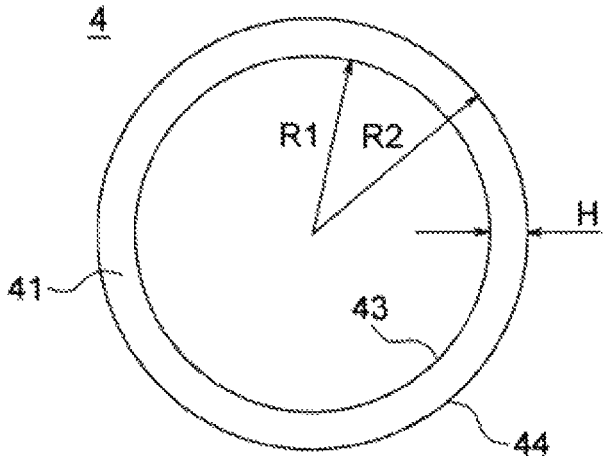

FIGS. 8A and 8B respectively show a perspective view and a front view showing a driven ring of the embodiment.

Figure 9A:
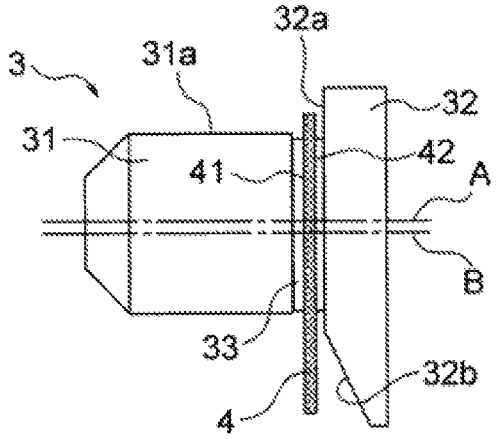
Figure 9B:
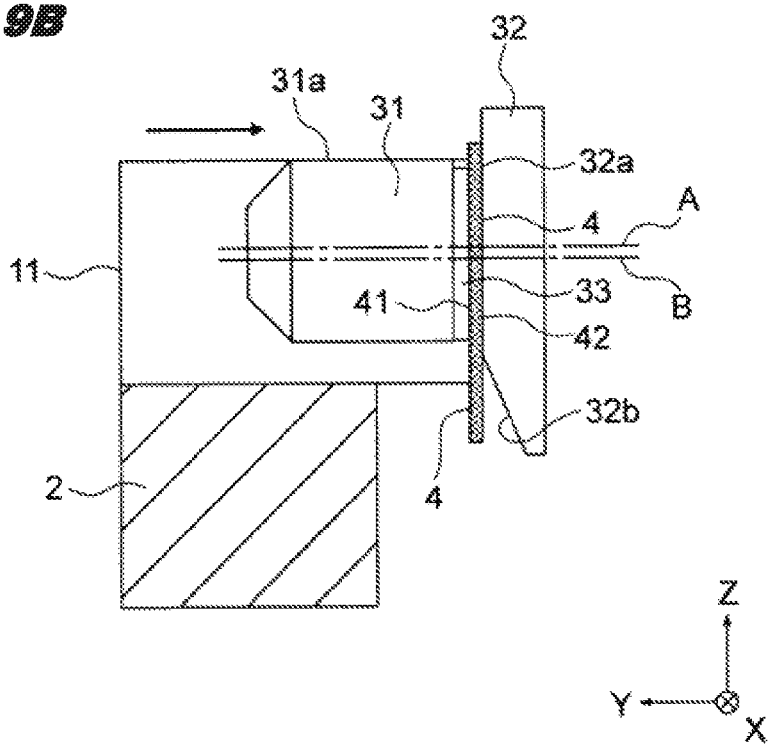

FIGS. 9A and 9B respectively show a schematic diagram (A) showing the flange member and the driven ring and a schematic diagram (B) showing a state of supporting the fuser belt of the embodiment.

FIG. 10 is a block diagram showing the control system of the image forming apparatus of the embodiment.

Figure 11:
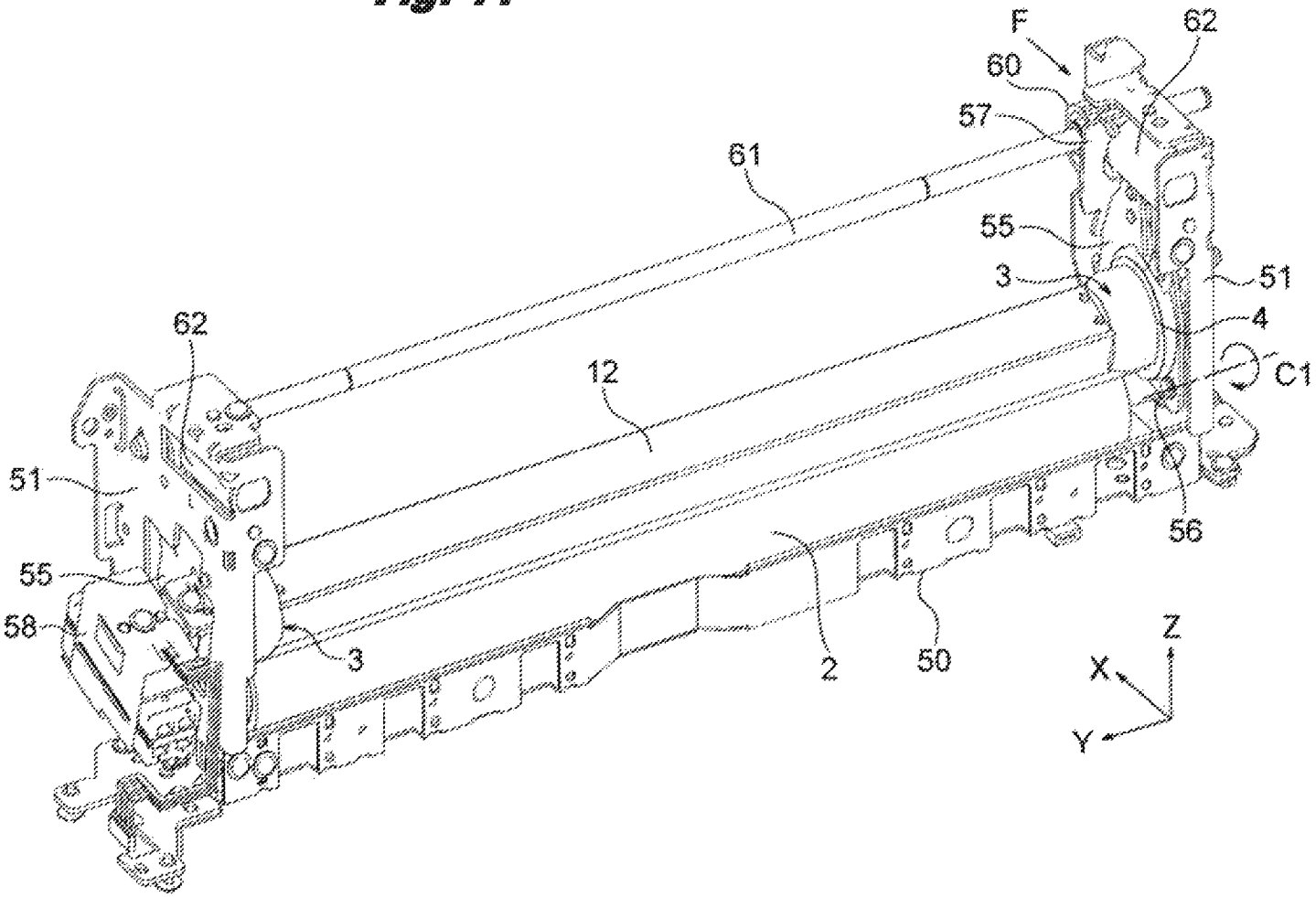

FIG. 11 is a perspective view of the fuser device for explaining the operation of a swing lever of the embodiment with the fuser belt and the top cover removed.

Figure 12:
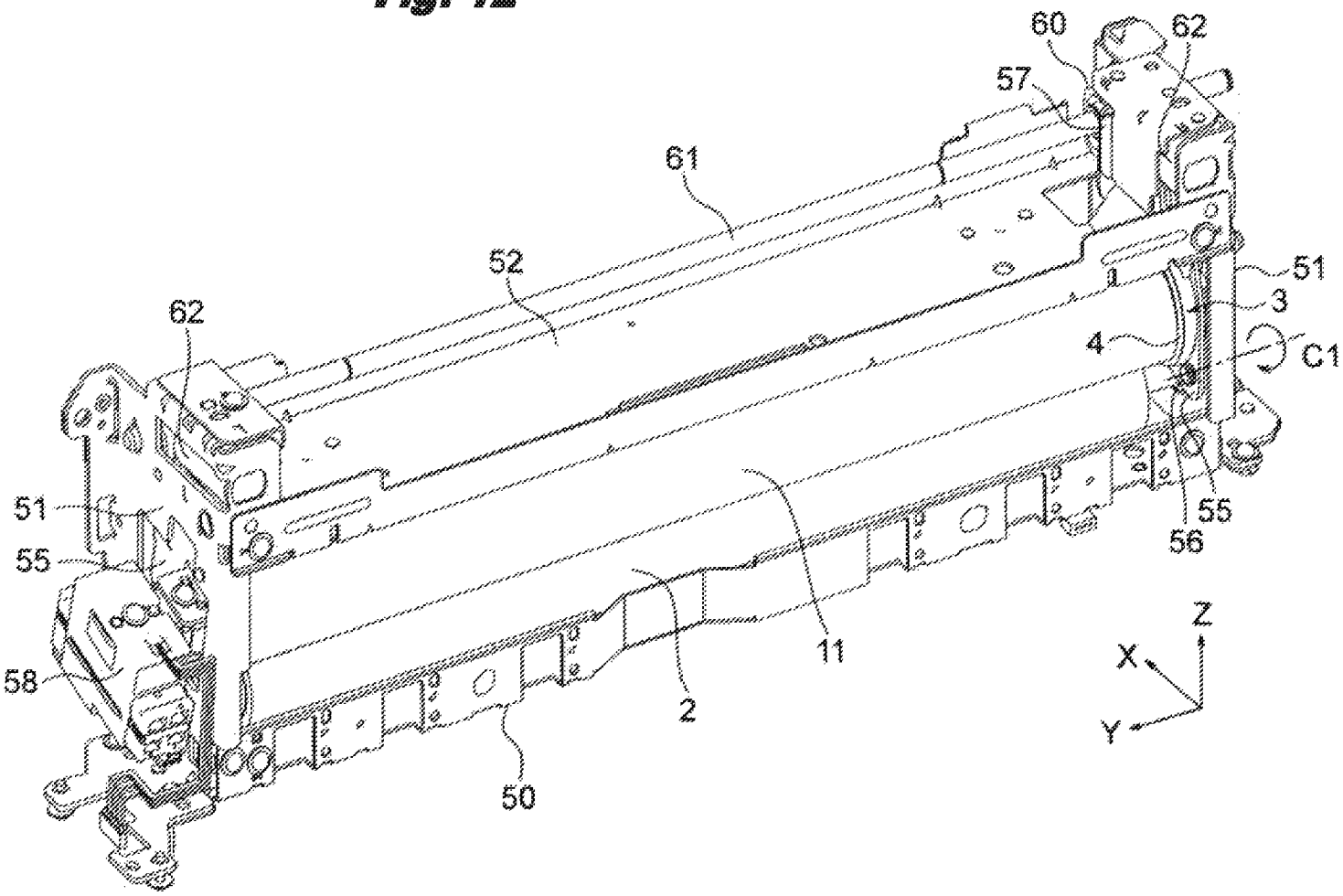

FIG. 12 is a perspective view of the fuser device for explaining the operation of the swing lever of the embodiment.

Figure 13A:
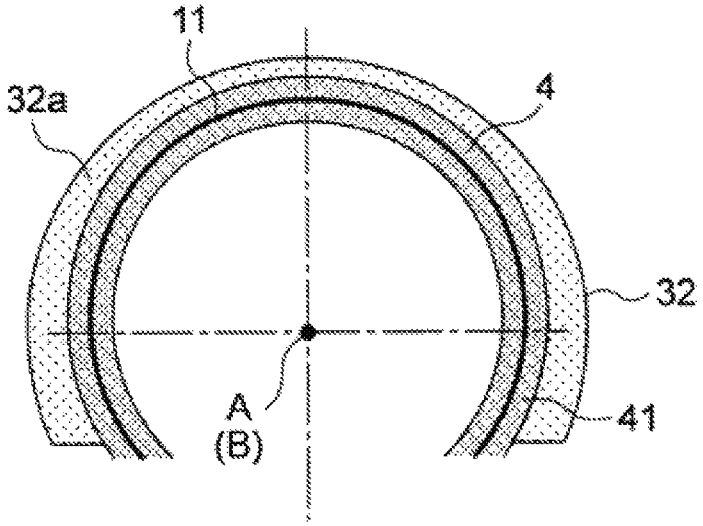
Figure 13B:
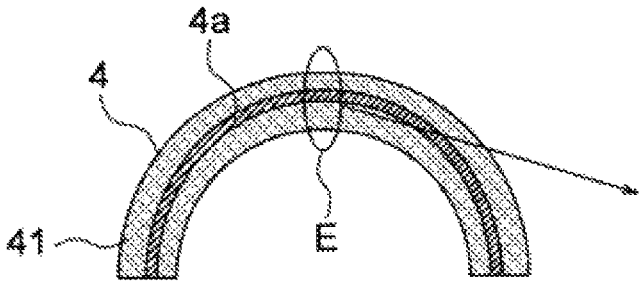
Figure 13C:
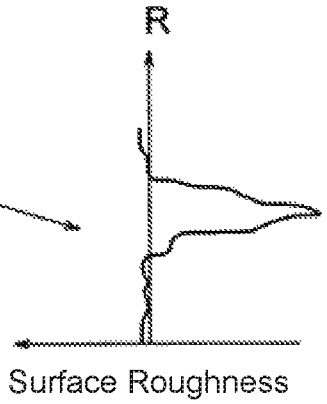

FIGS. 13A-13C respectively show a diagram (A) showing the positional relation of a fuser belt, a driven ring, and an abutting face, a schematic diagram (B) showing the surface condition of the driven ring, and a schematic diagram (C) showing an example of the surface roughness distribution of a comparative example.

Figure 14A:
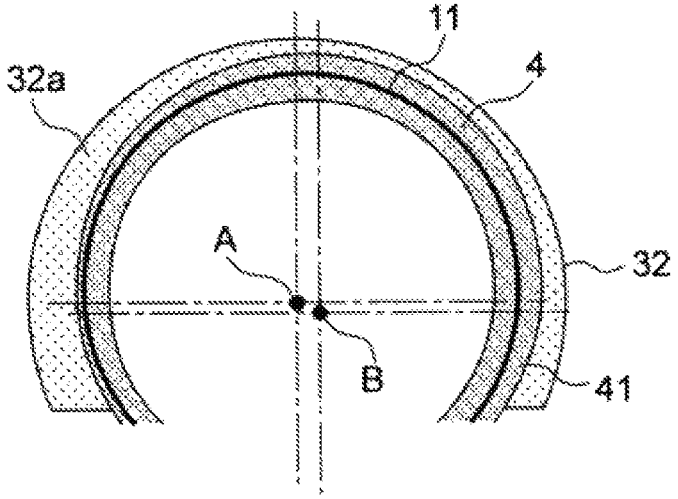
Figure 14B:
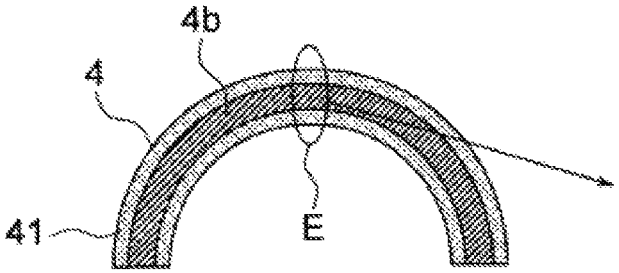
Figure 14C:
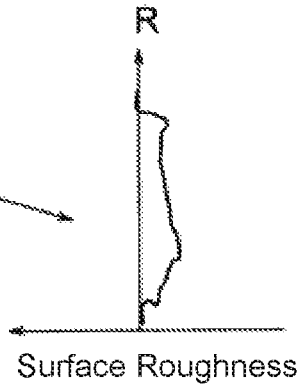

FIGS. 14A-14C respectively show a diagram (A) showing the positional relation of the fuser belt, the driven ring, and an abutting face, a schematic diagram (B) showing the surface condition of the driven ring, and a schematic diagram (C) showing an example of the surface roughness distribution of the embodiment.

DETAILED DESCRIPTION OF PREFERRED EMBODIMENTS

<Configuration of Image Forming Apparatus>

Figure 1:
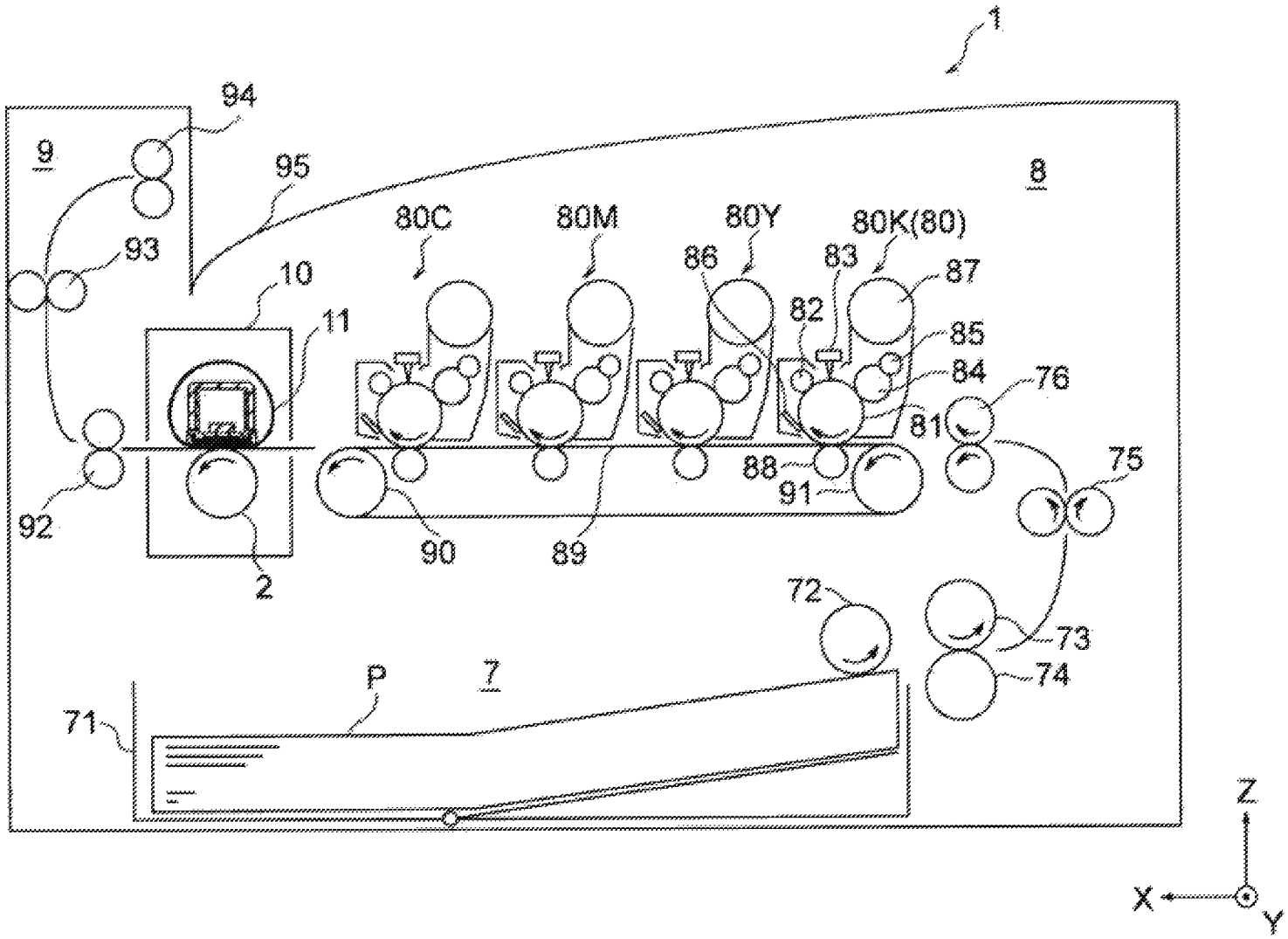
FIG. 1 is a diagram showing the basic configuration of an image forming apparatus of an embodiment of this invention.

First, explained is an image forming apparatus 1 provided with a fuser device 10 in an embodiment of this invention. FIG. 1 shows the configuration of the image forming apparatus 1 in this embodiment. The image forming apparatus 1 is a printer that forms a color image using an electrophotographic method, and is provided with a medium supply part 7 that supplies a medium P such as printer sheets, an image forming part 8 that forms a toner image (developer image) on the supplied medium P, a fuser device 10 that fuses the toner image to the medium P, and a medium ejection part 9 that ejects the medium P with the toner image fused to the outside of the image forming apparatus 1.

The medium supply part 7 has a sheet feeding tray 71 as a medium accommodation part that accommodates the medium P in a stacked state, a pickup roller 72 that extracts the medium P mounted on the sheet feeding tray 71 by one piece at a time, a feed roller 73 and a retard roller 74 that forward the extracted piece of medium P to a carrying route, and a carrying roller pairs 75 and 76 that carry the medium forwarded to the carrying route to the image forming part 8.

The image forming part 8 has four process units (developer image forming parts) 80K, 80Y, 80M, and 80C arranged in series in the below-mentioned X direction (from right to left in FIG. 1) along the carrying route of the medium P. The process units 80K, 80Y, 80M, and 80C form toner images with black, yellow, magenta, and cyan toners (developers), respectively. Because the process units 80K, 80Y, 80M, and 80C have a common configuration except for toners used, they are explained as a "process unit 80".

The process unit 80 has a photosensitive drum 81 as an image carrier that carries a toner image. The photosensitive drum 81 is a drum-shaped member having photosensitive layers (a charge generation layer and a charge transportation layer) installed on the surface of a conductive base body, and rotates clockwise in the figure.

The process unit 80 has a charging roller 82 as a charging member that uniformly charges the surface of the photosensitive drum 81, an exposure head 83 as an exposure device having an LED (Light-Emitting Diode) array for example that radiates light onto the surface of the uniformly-charged photosensitive drum 81, thereby forming an electrostatic latent image, a development roller 84 as a developer carrier that develops the electrostatic latent image with toner, a supply roller 85 as a supply member that supplies toner to the development roller 84, and a cleaning member 86 that scrapes off toner remaining on the surface of the photosensitive drum 81.

Also, the process unit 80 is provided with a detachable toner cartridge 87 as a developer supply part that supplies toner to the development roller 84 and the supply roller 85.

Opposing the photosensitive drums 81 of the process units 80K, 80Y, 80M, and 80C, four transfer rollers 88 are disposed. Applied to each of the transfer rollers 88 is a transfer voltage for transferring the toner image formed on the photosensitive drum 81 to the medium P.

Disposed in the downward direction (−Z direction mentioned below) of the process units 80K, 80Y, 80M, and 80C are an endless transfer belt 89 that adsorbs the medium P by an electrostatic force and carries it, a belt drive roller 90 for driving the transfer belt 89, and a tension roller 91 that gives a tension to the transfer belt 89.

In the downstream side of the image forming part 8 along the carrying route of the medium P, a fuser device 10 is installed. The fuser device 10 applies heat and a pressure to the toner image on the medium P, thereby melting and fusing the toner image to the medium P. The configuration of the fuser device 10 is mentioned below.

In the downstream side of the fuser device 10 along the carrying route of the medium P, a medium ejection part 9 is disposed. The medium ejection part 9 has ejection roller pairs 92, 93, and 94 that eject the medium P with the toner image fused. Installed on the top of the main body of the image forming apparatus 1 is a stacker part 95 for stacking the ejected medium P.

In FIG. 1, the carrying direction (the moving direction of the medium P) when the medium P passes the fuser device 10 is denoted as X direction. Also, the width direction of the medium P carried in the X direction is denoted as Y direction. The Y direction is parallel to the rotation axis of the photosensitive drum 81. Also the direction perpendicular to the X direction and the Y direction is denoted as Z direction.

As for the X direction, the carrying direction when the medium P passes the fuser device 10 is denoted as +X direction, and the opposite direction as −X direction. As for the Y direction, facing the +X direction, the left direction is denoted as +Y direction, and the right direction as −Y direction. As for the Z direction, in FIG. 1 the upward direction is denoted as +Z direction, and the downward direction as −Z direction.

<Configuration of Fuser Device>

Figure 2:
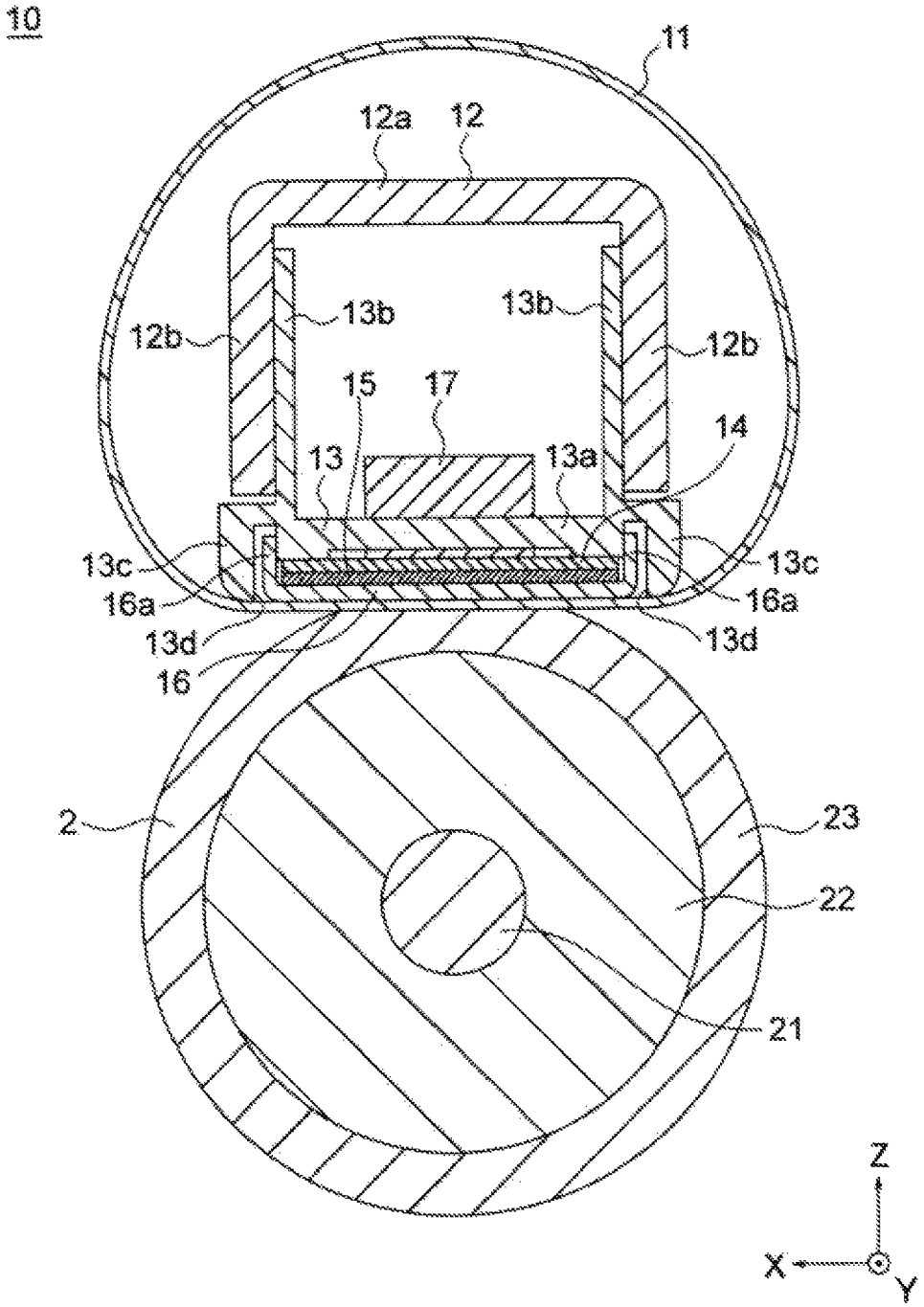
FIG. 2 is a cross-sectional view showing the configuration of a fuser device of the embodiment.

Next, explained is the configuration of the fuser device 10 in this embodiment. FIG. 2 is a cross-sectional view showing the fuser device 10. The fuser device 10 has a fuser belt 11 that is an endless belt, a heater 15 disposed on the inner circumferential side of the fuser belt 11, and a pressure application roller 2 as a pressure application member disposed on the outer circumferential side of the fuser belt 11.

The fuser belt 11 has a base layer of a metal (such as stainless steel), an elastic layer such as silicone rubber formed on the surface of the base layer, and a coating layer such as PFA (tetrafluoroethylene-perfluoroalkylvinylether copolymer) formed on the surface of the elastic layer. The thickness of the base layer is 30 μm for example, the thickness of the elastic layer is 300 μm for example, and the thickness of the coating layer is 20 μm for example. The inner diameter of the fuser belt 11 is 30 mm for example. The width direction of the fuser belt 11 is the Y direction.

The pressure application roller 2 is disposed in the downward direction (−Z direction) of the fuser belt 11. The pressure application roller 2 has a metallic shaft 21, an elastic layer 22 such as silicone rubber formed on the surface of the shaft 21, and a coating layer 23 such as PFA formed on the surface of the elastic layer 22. The axial direction of the pressure application roller 2 is the Y direction. The pressure application roller 2 forms a nip region between it and the fuser belt 11, and rotates by a rotation being transmitted from a fuser motor 214 (FIG. 10) mentioned below. At the nip region, the medium is pressed and heated so that toner disposed on the medium is fused while passing through the nip region.

Disposed on the inner circumferential side of the fuser belt 11 are a stay 12, a heater supporting member 13, a heat conducting member 14, a heater 15, a heat diffusing member 16, and a temperature sensor 17.

The stay 12 is a member elongated in the Y direction, and has an approximately U-shaped cross section on the plane perpendicular to the Y direction. More specifically, the stay 12 comprises two side plate parts 12*b* opposing each other in the X direction, and a top plate part 12*a* that connects the upper ends of the side plate parts 12*b*. The stay 12 is a structural part that supports the heater supporting member 13, the heat conducting member 14, the heater 15, the heat diffusing member 16, and the temperature sensor 17. The stay 12 is formed of a metal such as electrogalvanized steel sheet for example.

The heater supporting member 13 is fixed to the lower side (−Z direction) of the stay 12. The heater supporting member 13 supports the heater 15 to the stay 12. The heater supporting member 13 comprises two side plate parts 13*b* fixed to the inner sides of the two side plate parts 12*b* of the stay 12, and a bottom plate part 13*a* that connects the lower ends of the side plate parts 13*b*.

The lower face (−Z direction face) of the bottom plate part 13*a* of the heater supporting member 13 is in contact with the heat conducting member 14 explained below. Formed on each of both ends in the X direction of the bottom plate part 13*a* is a groove part 13*d* elongated in the Y direction. The heater supporting member 13 is formed of a resin such as PEEK (polyetheretherketone) for example.

The heat conducting member 14 is a plate-shaped member for example, that is disposed between the heater supporting member 13 and the heater 15 explained next. The heat conducting member 14 is formed of a material such as stainless steel (SUS) having high heat resistance and high heat conductivity. The upper face (+Z direction face) of the heat conducting member 14 is in contact with the lower face of the bottom plate part 13*a* of the heater supporting member 13.

The heater 15 is a plate-shaped heat source (plate-shaped heater) that applies heat to the fuser belt 11. The heater 15 has a resistance wire as a heat emitting body, and emits heat by supplying an electric current to the resistance wire. The upper face of the heater 15 is in contact with the lower face of the heat conducting member 14.

The heat diffusing member 16 is disposed between the heater 15 and the fuser belt 11, and transmits heat of the heater 15 to the fuser belt 11. The heat diffusing member 16 is formed of a material having high heat resistance and high thermal conductivity, such as stainless steel with a glass coating. The upper face of the heat diffusing member 16 is in contact with the lower face of the heater 15, and the lower face of the heat diffusing member 16 is in contact with the inner circumference face of the fuser belt 11.

The heat diffusing member 16 is formed by bending upwards (to the heater 15 side) both ends of a plate-shaped member elongated in the Y direction to form a pair of bent parts 16*a*. Each of the bent parts 16*a* is inserted and fixed to the groove part 13*d* of the bottom plate part 13*a* of the heater supporting member 13. The heat conducting member 14 and the heater 15 are held in a state of being sandwiched in the Z direction by the bottom plate part 13*a* of the heater supporting member 13 and the heat diffusing member 16.

Also, given to the lower face of the heat diffusing member 16 (that is, a face in contact with the fuser belt 11) is a sliding grease for reducing swing resistance (a frictional force) with the inner circumferential face of the fuser belt 11.

Also, the temperature sensor 17 is disposed in contact with the upper face of the heat conducting member 14. The temperature sensor 17 detects temperature of the heater 15 through the heat conducting member 14, and is supported by the heater supporting member 13. The output signal of the temperature sensor 17 is sent to a heater control part 211 (FIG. 10) mentioned below, based on which the temperature control of the heater 15 is performed.

Figure 3:
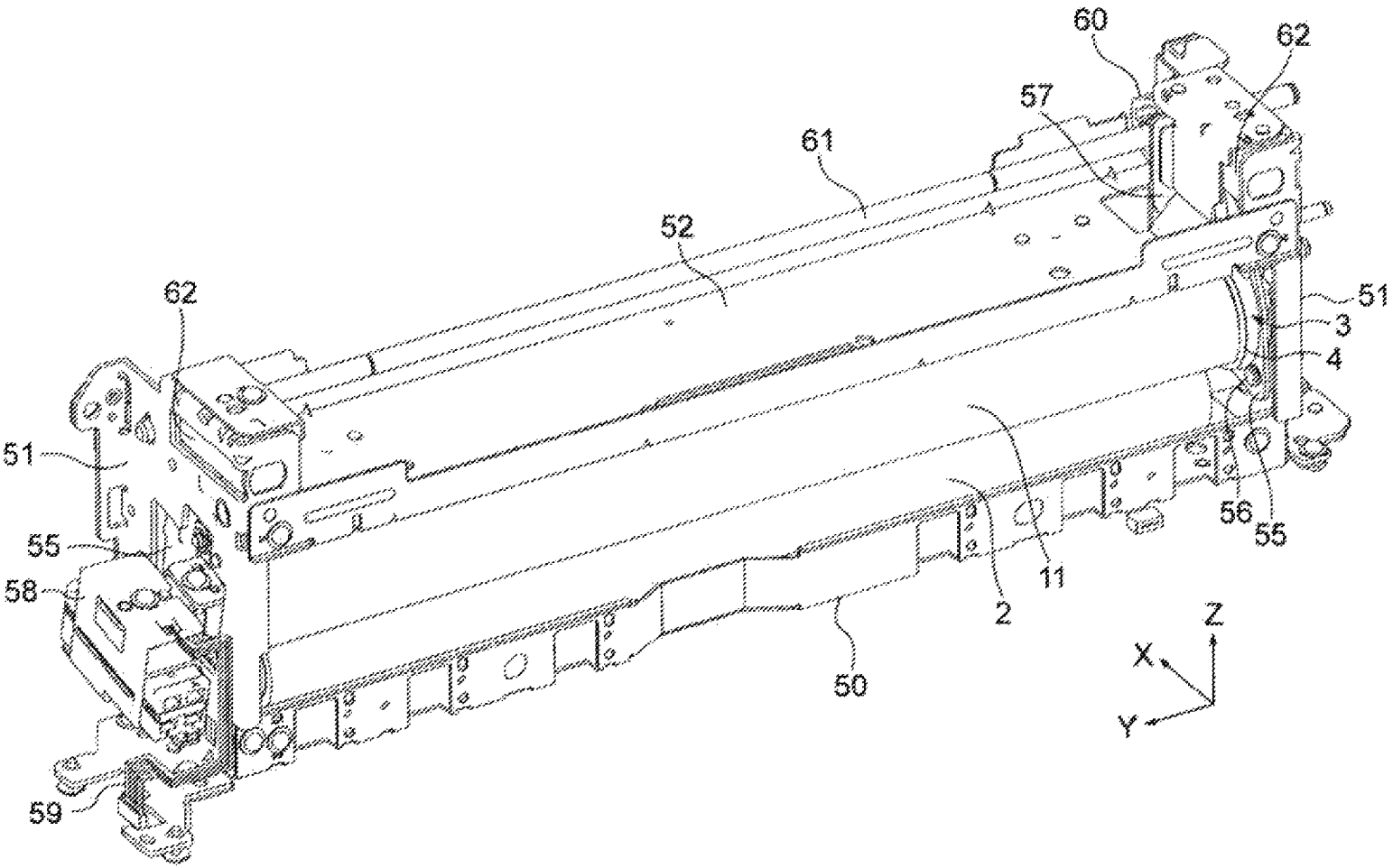
FIG. 3 is a perspective view showing the configuration of the fuser device of the embodiment.
Figure 4:
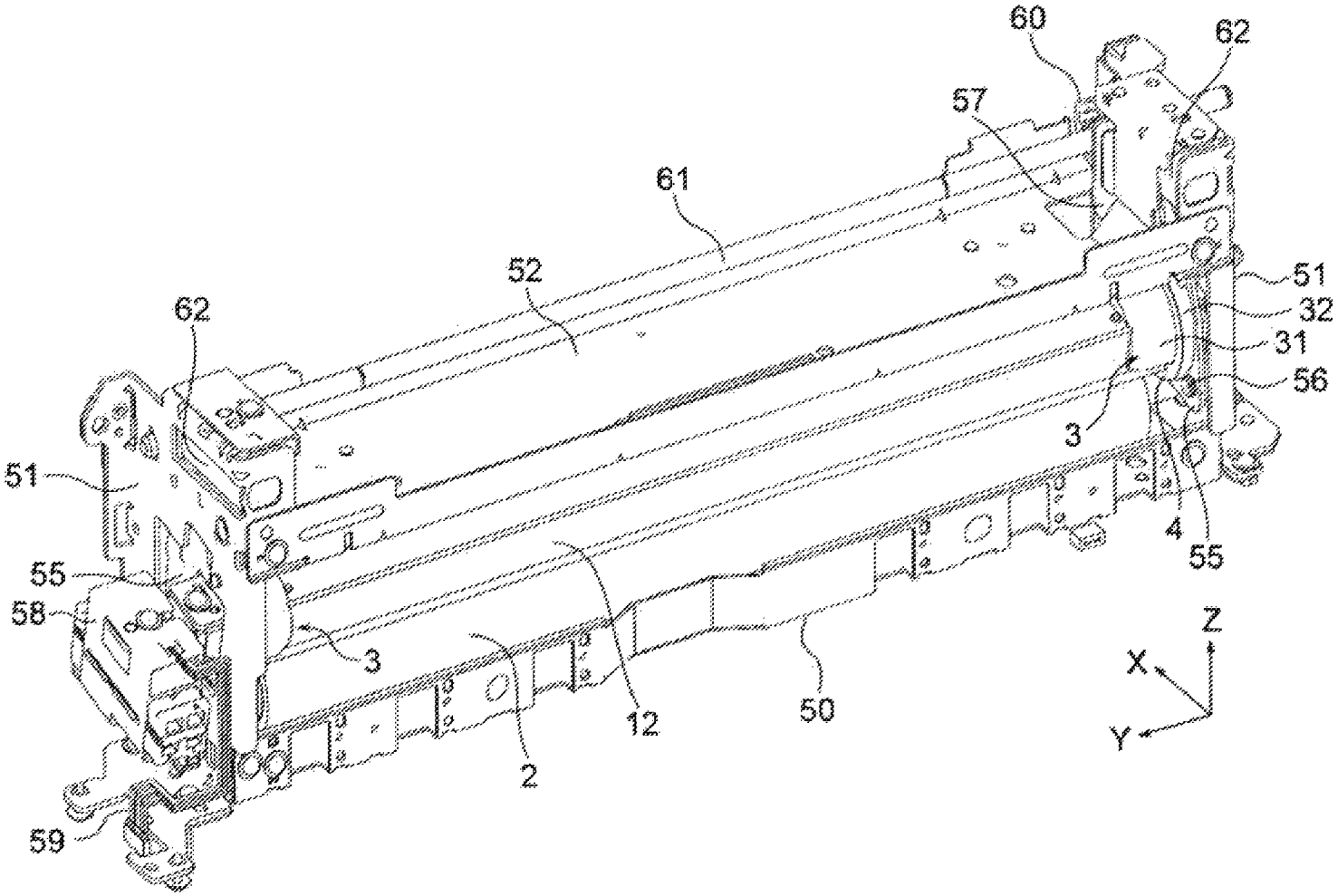
FIG. 4 is a perspective view showing the configuration of the fuser device of the embodiment with a fuser belt removed.

FIG. 3 is a perspective view showing the fuser device 10. FIG. 4 is a perspective view of the fuser device 10 shown with the fuser belt 11 removed. The fuser device 10 has a pair of side frames 51 opposing each other in the Y direction, a base part 50 that supports the side frames 51 from below (−Z direction), and a top cover 52 positioned in the upper (+Z direction) part of the side frames 51.

The fuser belt 11, the stay 12, the heater supporting member 13, the heat conducting member 14, the heater 15, the heat diffusing member 16, the temperature sensor 17, and the pressure application roller 2 mentioned above are disposed between the pair of side frames 51 in the Y direction. Also, the pressure application roller 2 is rotatably supported by this pair of side frames 51.

As shown in FIG. 4, installed on the inner sides in the Y direction of the pair of side frames 51 is a pair of swing levers 55. Each of the swing levers 55 is swingably attached to the side frame 51 by a support shaft 56 in the Y direction. The support shaft 56 is disposed on the lower end (−Z direction end) and −X direction end part of the swing lever 55.

Attached to each of the swing levers 55 is a flange member 3 in an approximate cylindrical shape. The flange member 3 supports the fuser belt 11 from the inner circumferential side on both sides in the width direction of the fuser belt 11 (FIG. 3). Also, driven rings 4 are installed opposing end parts in the width direction of the fuser belt 11 (FIG. 3). Note that one of the driven rings 4 is hidden behind the side frame 51 in FIGS. 3 and 4.

Fixed to the swing levers 55 are Y direction end parts of the stay 12 penetrating the interior of the flange members 3 as mentioned below. That is, the pair of swing levers 55 supports the fuser belt 11 through the pair of flange members 3, and supports the stay 12 and the components (the heater supporting member 13, the heat conducting member 14, the heater 15, the heat diffusing member 16, and the temperature sensor 17) supported by it.

Figure 5:
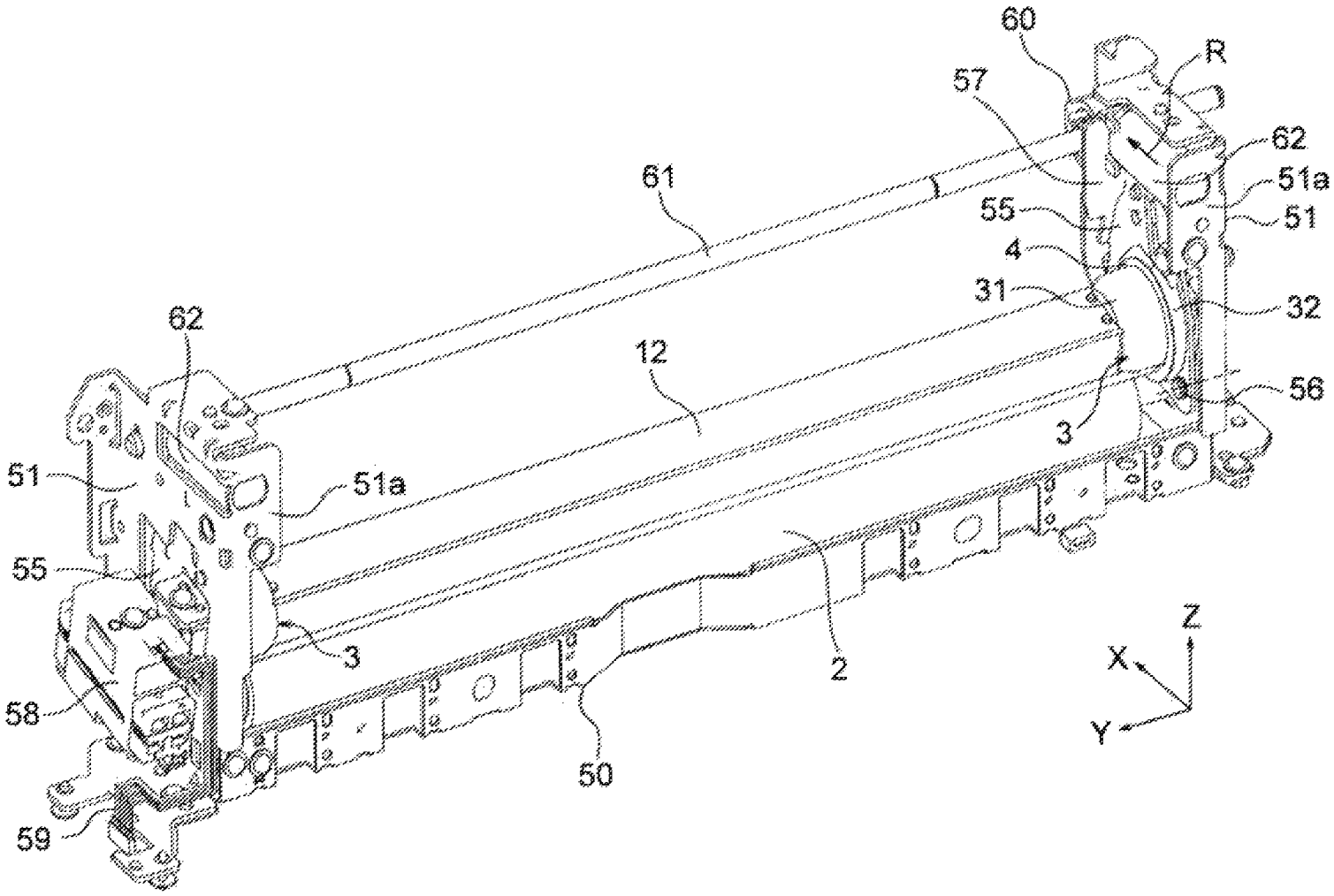
FIG. 5 is a perspective view showing the configuration of the fuser device of the embodiment with the fuser belt and a top cover removed.

FIG. 5 is a perspective view showing a state where the fuser belt 11 and the top cover 52 are removed from the fuser device 10. Installed on the upper end (+Z direction end) and +X direction end part of the swing lever 55 is a contact plate 57. The contact plate 57 has a plate face perpendicular to the X direction for example.

Attached to each of the side frames 51 on the −X side of the contact plate 57 of the swing lever 55 is a coil spring 62 as a bias member. The winding axis direction of the coil spring 62 is the X direction. The −X direction end part of the coil spring 62 is in contact with the contact plate 57. The +X direction end part of the coil spring 62 is in contact with a wall part 51*a* of the side frame 51. Thereby, the coil spring 62 biases the contact plate 57 of the swing lever 55 in a direction indicated with an arrow R in FIG. 5.

Attached to each of the side frames 51 on the +X side of the contact plate 57 of the swing lever 55 is a cam 60 as a drive mechanism. In FIG. 5, one of the cams 60 is hidden behind the side frame 51. The pair of cams 60 is attached to a rotation shaft 61 extending in the Y direction. Both ends of the rotation shaft 61 are rotatably supported by supporting holes 51*b* formed on the side frames 51. The outer circumferential face of the cam 60 is in contact with the +X side face of the contact plate 57. That is, the contact plate 57 is pressed against the outer circumferential face of the cam 60 by the bias force of the coil spring 62.

The cam 60 rotates by a rotation transmitted from a cam motor 216 (FIG. 10) mentioned below. By the cam 60 rotating, the position of the contact plate 57 varies, thereby the swing lever 55 swings centering on the support shaft 56. By this swing lever 55 swinging, the fuser belt 11 (FIG. 3) moves toward or away from the pressure application roller 2.

Attached on one of the side frames 51 is a terminal part 58 for supplying an electric current to the heater 15 (FIG. 2) on the inner circumferential side of the fuser belt 11. A wiring 59 is extracted from the terminal part 58 and connected to a heater control part 211 (FIG. 10). The output of the temperature sensor 17 (FIG. 2) is also outputted from the terminal part 58 to the heater control part 211 (FIG. 10).

FIGS. 6A-6C are respectively a perspective view (A), a front view (B), and a side view (C) showing the flange member 3. Note that although only one flange member 3 is shown in FIGS. 6A-6C, the other flange member 3 has a symmetric shape with the flange member 3 shown in FIGS. 6A-6C with respect to the Y direction center.

The flange member 3 is formed of a resin such as PPS (polyphenylene sulfide) for example. As shown in FIGS. 6A-6C, the flange member 3 has a belt supporting part 31 in an approximate cylindrical shape that supports the fuser belt 11, and a connecting part 32 adjacent in the Y direction to the belt supporting part 31.

The belt supporting part 31 has a contact face 31*a* shaped in an arc centering on a central axis A (first central axis) extending in the Y direction. This contact face 31*a* is the face where the inner circumferential face of the fuser belt 11 slides. The radius (that is, the distance from the central axis A to the contact face 31*a*) of the belt supporting part 31 is 14.9 mm for example.

The belt supporting part 31 has a rectangular inner circumferential part 31*b* that fits with the stay 12 (FIG. 2) mentioned above. The Y direction end part of the stay 12 shown in FIG. 4 penetrates the inner circumferential part 31*b* of the belt supporting part 31 and is fixed to the swing lever 55.

The belt supporting part 31 is not perfectly cylindrical but has an opening part 31*c* on its lower end part (−Z direction end part). Via this opening part 31*c*, the heater supporting member 13 (FIG. 2) attached to the say 12 opposes the fuser belt 11.

The belt supporting part 31 has a tapered face 31*d* on the opposite side of the connecting part 32 in the Y direction. This tapered face 31*d* is installed for making it easy to attach the fuser belt 11 to the contact face 31*a* of the belt supporting part 31.

The connecting part 32 is an approximate ring-shaped part extruding radially to the outside from the belt supporting part 31. The face (−Y direction face) of the connecting part 32 on the side of the belt supporting part 31 is an abutting face 32*a* that contacts with the driven ring 4. The abutting face 32*a* is a face parallel to the XZ plane. Formed on the lower end part (−Z direction end part) of the connecting part 32 is a tapered face 32*b* that is inclined relative to the XZ plane, see FIGS. 6A and 6C.

Formed on the upper end part (+Z direction end part) of the connecting part 32 is a fixing hole 32*c* for a screw to penetrate. By a screw penetrating the fixing hole 32*c*, the flange member 3 is fixed to the swing lever 55.

As shown in FIG. 6C, formed on the connecting part 32 side end part of the belt supporting part 31 is a ring supporting groove 33 as a ring supporting part that supports the driven ring 4. This ring supporting groove 33 is a part that rotatably supports the driven ring 4. The bottom part (contact face) 33*a* of this ring supporting groove 33 extends in an arc shape centering on a central axis B (second central axis) extending in the Y direction. The distance from the central axis B to the bottom face 33*a* of the ring supporting groove 33 is 14.4 mm for example.

When defining first angle θ1, which is around the central axis A, of the contact face 31*a* and second angle θ2, which is around the central axis B, of the contact face 33*a*, it is preferred to satisfy the follow:

$$\theta 1=\theta 2$$

$$210°\leq\theta 1\leq 225°$$

$$210°\leq\theta 2\leq 225°.$$

As shown in FIGS. 6B and 6C, the central axis A of the arc that defines the contact face 31*a* of the belt supporting part 31 and the central axis B of the arc that defines the bottom face 33*a* of the ring supporting groove 33 are in mutually shifted positions.

FIG. 7 is a schematic diagram for explaining the groove shape of the ring supporting groove 33. The depth D of the ring supporting groove 33 (that is, the distance from the contact face 31*a* of the belt supporting part 31 to the bottom face 33*a* of the ring supporting groove 33) varies along the circumferential direction of the belt supporting part 31 (that is, the extending direction of the ring supporting groove 33). Such a configuration as this allows realizing a positional relation that the central axis A and the central axis B are shifted from each other.

If the inner diameter of the fuser belt 11 is set to 30 mm, and the inner diameter of the driven ring 4 to 29.2 mm, the distance S between the central axis A and the central axis B should desirably be 0.4 mm or less. As mentioned below, it is to prevent the fuser belt 11 from extruding from the inner circumferential edge of the driven ring 4. Although the central axis A and the central axis B are shifted in both the X direction and the Z direction here, this invention is not limited to this, but they can be shifted only in the X direction or only in the Z direction.

Also, as shown in FIG. 7, the distance L1 from the central axis A to the contact face 31*a* is 14.9 mm for example, and the distance L2 from the central axis B to the bottom face 33*a* of the ring supporting groove 33 is 14.4 mm for example. The distance S between the central axis A and the central axis B is 0.2 mm for example.

FIG. 8 shows a perspective view (A) and a front view (B) showing the shape of the driven ring 4. The driven ring 4 has an inner circumference 43 and an outer circumference 44, both of which are circular. Also, the driven ring 4 has a first contact face 41 contacting with the end face of the fuser belt 11, and a second contact face 42 contacting with the abutting face 32*a* of the flange member 3.

It is preferred that distance S, distance L1 from the central axis A to the contact face 31*a* and distance L2 from the central axis B to the contact face 33*a* satisfy the follows:

$$6.67\leq S/L1\leq 26.7$$

$$6.65\leq S/L2\leq 27.4$$

$$0.25\leq S/(L1-L2)\leq 1.0.$$

The driven ring 4 is formed of a resin such as PEEK (polyetheretherketone) or PPS. The inner diameter R1 of the driven ring 4 is 29.2 mm for example, and the outer diameter R2 is 35 mm for example. The width H of the driven ring 4 is 2.9 mm for example, which is constant over the circumferential direction. The thickness T of the driven ring 4 is 0.3 mm for example. That is, the driven ring 4 has a thickness allowing it to bend in the thickness direction. In this embodiment, it is preferred that the width H is ranged from 2.0 mm to 6.0 mm. The width may vary around its axis (or over the circumferential direction). Further, in the present invention, the width H may be determined considering a value of distance L, see FIG. 7. With respect to L1, the width H may be ranged from 13% to 40%.

FIG. 9A is a schematic diagram showing a state where the driven ring 4 is attached to the ring supporting groove 33 of the flange member 3. The width of the ring supporting groove 33 is larger than the thickness of the driven ring 4, therefore the driven ring 4 can move in the Y direction inside the ring supporting groove 33. The first contact face 41 of the driven ring 4 is oriented to the belt supporting part 31 side, and the second contact face 42 of the driven ring 4 opposes the abutting face 32*a*.

FIG. 9B is a schematic diagram showing the positional relation of the flange member 3, the driven ring 4, the fuser belt 11, and the pressure application roller 2. Once the fuser belt 11 is attached to the belt supporting part 31 of the flange member 3, an end face in the width direction (Y direction) of the fuser belt 11 opposes the first contact face 41 of the driven ring 4.

Along with the rotation of the fuser belt 11, if the fuser belt 11 shifts in the Y direction as indicated with an arrow, the Y direction end face of the fuser belt 11 contacts the first contact face 41 of the driven ring 4. Thereby, the driven ring 4 moves to the abutting face 32*a* side, and the second contact face 42 contacts with the abutting face 32*a*. Thereby, the Y direction position of the fuser belt 11 is regulated.

Also, on the lower part of the belt supporting part 31 (the part where the opening part 31*c* shown in FIG. 6 is formed), the fuser belt 11 is not in contact with the contact face 31*a*, therefore when the fuser belt 11 that passed this part contacts with the contact face 31*a* again, it may be displaced in the Y direction. In that case, the driven ring 4 can bend, and this bending of the driven ring 4 can be released on the tapered face 32*b*.

<Control System of Image Forming Apparatus>

Next, explained is the control system of the image forming apparatus 1. FIG. 10 is a block diagram showing the control system of the image forming apparatus 1. The image forming apparatus 1 is provided with a control part 200, an I/F (interface) control part 201, receiving memory 202, image data editing memory 203, an operation part 204, a sensor group 205, a charging roller power supply 206, a development roller power supply 207, a supply roller power supply 208, a transfer roller power supply 209, a head control part 210, a heater control part 211, a fuser drive control part 213, a cam drive control part 215, a carrying control part 217, a drive control part 219, and a belt drive control part 221.

The control part 200 comprises a microprocessor, ROM (Read Only Memory), RAM (Random Access Memory), an input/output port, a timer, etc. The control part 200 receives print data and control commands through the I/F control part 201 from a host device, and performs the print operation of the image forming apparatus 1.

The receiving memory 202 temporarily stores the print data inputted through the I/F control part 201 from the host device. The image data editing memory 203 receives the print data stored in the receiving memory 202 and also records image data formed by editing the print data.

The operation part 204 is provided with a display part (such as an LED) for displaying the state of the image forming apparatus 1, and an operation part (such as switches) for an operator to input instructions. The sensor group 205 includes various sensors such as a medium position sensor, a temperature/humidity sensor, and a density sensor for monitoring the operation state of the image forming apparatus 1.

By the control of the control part 200, the charging roller power supply 206 applies a charging voltage to the charging roller 82 for uniformly charging the surface of the photosensitive drum 81. By the control of the control part 200, the development roller power supply 207 applies a development voltage to the development roller 84 for developing an electrostatic latent image on the surface of the photosensitive drum 81.

By the control of the control part 200, the supply roller power supply 208 applies a supply voltage to the supply roller 85 for supplying toner to the development roller 84. By the control of the control part 200, the transfer roller power supply 209 applies a transfer voltage to the transfer roller 88 for transferring a toner image on the photosensitive drum 81 to the medium P.

The head control part 210 sends the image data recorded in the image data editing memory 203 to the exposure head 83, and controls the emission of the exposure head 83. The heater control part (fuser control part) 211 is a temperature adjustment circuit that supplies a prescribed electric current from the heater power supply 212 to the heater 15 (FIG. 2) based on the output signal of the temperature sensor 17 (FIG. 2) of the fuser device 10.

The fuser drive control part 213 rotates the fuser motor 214 to rotate the pressure application roller 2 (FIG. 2) of the fuser device 10. The cam drive control part 215 rotates the cam motor 216 to rotate the cam 60 (FIGS. 3-5). Thereby, the cam 60 swings the swing lever 55, and the fuser belt 11 moves toward or away from the pressure application roller 2.

The carrying control part 217 controls the rotation of the carrying motor 218 to rotate the pickup roller 72, the feed roller 73, the carrying roller pairs 75 and 76 shown in FIG. 1 for carrying the medium P. The drive control part 219 rotates a drive motor 220 for rotating the photosensitive drum 81, the development roller 84, the supply roller 85, etc. of each process unit 80.

The belt drive control part 221 controls the rotation of a belt motor 222 to rotate the belt drive roller 90 for driving the transfer belt 89. Note that the ejection roller pairs 92, 93, and 94 rotate by a rotation transmitted from the fuser motor 214.

<Operations of Image Forming Apparatus>

Next, explained are the operations of the image forming apparatus 1 referring to Figs. and 10. Upon receiving a print command and print data through the I/F control part 201 from the upper-level device, the control part 200 of the image forming apparatus 1 starts an image forming (print) operation. The control part 200 temporarily records the print data in the receiving memory 202, generates image data by editing the recorded print data, and records the data in the image data editing memory 203.

The control part 200 also drives the carrying motor 218 by the carrying control part 217. Thereby, the pickup roller 72 and the feed roller 73 rotate to forward the medium P contained in the sheet feeding tray 71 by one piece at a time to the carrying route. Furthermore, the carrying roller pairs 75 and 76 carry the medium P along the carrying route to the image forming part 8.

In the image forming part 8, the transfer belt 89 that rotates by the belt drive roller 90 adsorbs and carries the medium P. The medium passes through the process units 80K, 80Y, 80M, and 80C sequentially in that order.

The control part 200 performs the formation of color toner images in the process units 80K, 80Y, 80M, and 80C. That is, the control part 200 applies the charging voltage, the development voltage, and the supply voltage from the charging roller power supply 206, the development roller power supply 207, and the supply roller power supply 208 to the charging roller 82, the development roller 84, and the supply roller 85 of each of the process units 80, respectively.

The control part 200 also rotates the drive motor 220 by the drive control part 219 to rotate the photosensitive drum 81. Along with the rotation of the photosensitive drum 81, the charging roller 82, the development roller 84, and the supply roller 85 also rotate. The charging roller 82 uniformly charges the surface of the photosensitive drum 81 by its charging voltage.

The control part 200 further controls the emission of the head control part 210 based on the image data recorded in the image data editing memory 203. The head control part 210 exposes the surface of the uniformly charged photosensitive drum 81 by the exposure head 83 to form an electrostatic latent image.

The electrostatic latent image formed on the surface of the photosensitive drum 81 is developed with toner adhering to the development roller 84, thereby a toner image is formed on the surface of the photosensitive drum 81. Once the toner image approaches the surface of the transfer belt 89 by the rotation of the photosensitive drum 81, the control part 200 applies the transfer voltage to the transfer roller 88 from the transfer roller power supply 209. Thereby, the toner image formed on the photosensitive drum 81 is transferred to the medium P on the transfer belt 89. Toner that was not transferred to the medium P is scraped off by the cleaning member 86.

In this manner, the individual color toner images formed in the process units 80K, 80Y, 80M, and 80C are sequentially transferred to the medium P and superimposed over one another. The medium P to which the individual color toner images transferred is carried further by the transfer belt 89 and reaches the fuser device 10.

In the fuser device 10, the fuser belt 11 rotates, and the heater 15 is heated by the heater control part 211 and has reached prescribed fusing temperature. To the medium P carried to the fuser device 10, heat and a pressure are applied between the fuser belt 11 and the pressure application roller 2, thereby the toner image is fused to the medium P.

The medium P to which the toner image is fused is ejected to the outside of the image forming apparatus 1 by the ejection roller pairs 92, 93, and 94, and stacked on the stacker part 95. Thereby, a color image formation to the medium P is complete.

<Operations of Fuser Device>

Here, explained are the operations of the fuser device 10. First, a contact/separation operation of the fuser belt 11 and the pressure application roller 2 is explained. At the end of the fusing operation, the fuser device 10 performs a separation operation that separates the fuser belt 11 from the pressure application roller 2. Specifically, the control part 200 drives the cam motor 216 to rotate the cam 60.

FIGS. 11 and 12 are diagrams showing the fuser device 10 in the separation operation. FIG. 11 shows a state where the fuser belt 11 and the top cover 52 are removed, and FIG. 12 shows a state where the fuser belt 11 and the top cover 52 are attached.

As shown in FIG. 11, in the separation operation, the control part 200 drives the cam motor 216 (FIG. 10) to rotate the cam 60 in a prescribed direction. The cam 60 presses the contact plate 57 of the swing lever 55 in the −X direction as indicated with an arrow F. Thereby, the swing lever 55 swings in a direction indicated with an arrow C1 centering on the support shaft 56, resisting a bias force of the coil spring 62. Thereby, as shown in FIG. 12, the fuser belt 11 separates upwards from the pressure application roller 2.

On the other hand, performed in starting the fusing operation is a contact operation that has the fuser belt 11 contact with the pressure application roller 2. In this case, the control part 200 drives the cam motor 216 to rotate the cam 60 in the opposite direction from that in the separation operation. Thereby, the pressing force to the contact plate 57 by the cam 60 weakens, therefore the swing lever 55 swings in the opposite direction from that of the arrow C1 centering on the support shaft 56 by the bias force of the coil spring 62. Thereby, as shown in FIGS. 2 and 3, the fuser belt 11 contacts with the pressure application roller 2, forming the nip part.

In starting the fusing operation, the control part 200 drives the fuser motor 214 (FIG. 10) to rotate the pressure application roller 2. Once the pressure application roller 2 rotates, the fuser belt 11 in contact with the pressure application roller 2 rotates following the pressure application roller 2.

Also, at about the same time as the pressure application roller 2 starts rotating, an electric current is supplied to the heater 15 from the heater power supply 212 (FIG. 10). The heater 15 emits heat by the electric current supplied, and heat of the heater 15 is transmitted to the fuser belt 11 through the heat diffusing member 16. The temperature sensor 17 detects the temperature of the heater 15 through the heat conducting member 14, and outputs it to the heater control part 211 (FIG. 10). The heater control part 211 controls the electric current supplied to the heater 15 so that the temperature of the fuser belt 11 is maintained at target temperature.

The medium P to which the toner image was transferred in the image forming part 8 (FIG. 1) enters the nip part between the fuser belt 11 and the pressure application roller 2. Then, by heat applied by the fuser belt 11 and a pressure of being nipped by the fuser belt 11 and the pressure application roller 2, the toner melts and is fused to the medium P.

<Efficacy of Embodiment>

In the above-mentioned fusing operation, along with the rotation of the fuser belt 11, the fuser belt 11 shifts in the +Y direction or the −Y direction. In that case, as explained referring to FIG. 9B, an end part of the fuser belt 11 contacts with the driven ring 4, and the driven ring 4 contacts with the abutting face 32*a*, thereby the width-direction position of the fuser belt 11 is regulated.

This driven ring 4 rotates following the fuser belt 11 due to its contact with the end face of the fuser belt 11. At this time, because a speed difference can easily occur between the rotation speed of the fuser belt 11 and the rotation speed of the driven ring 4, due to friction with the end face of the fuser belt 11, the surface of the driven ring 4 wears out. Below, this point is explained.

FIG. 13A is a schematic diagram showing a contact state of a fuser belt 11, a driven ring 4, and an abutting face 32*a* in a comparative example. In this comparative example, the central axis A of an arc formed by a contact face 31*a* of a belt supporting part 31 and the central axis of an arc formed by a bottom face 33*a* of a ring supporting groove 33 coincide with each other.

In this case, the fuser belt 11 rotates centering on the central axis A, and the driven ring 4 also rotates centering on the central axis A. Therefore, a contact region with the fuser belt 11 on the surface of the driven ring 4 (that is, a first contact face 41 shown in FIG. 8) becomes a narrow region shaped in a ring centering on the central axis A. Therefore, the surface of the driven ring 4 can be shaved, thereby forming a groove.

FIG. 13B is a schematic diagram showing a state that a groove 4*a* has occurred on the driven ring 4 in the comparative example. FIG. 13C is a schematic diagram showing an example of the surface roughness distribution of a part indicated with a code E in FIG. 13B. In FIG. 13C, the vertical axis indicates the radial position (R), and the horizontal axis the surface roughness. As mentioned above, because the contact region with the fuser belt 11 on the surface of the driven ring 4 is a narrow ring-shaped region, the surface of the driven ring 4 is shaved off to form the deep groove 4*a*. If the groove 4*a* on the surface of the driven ring 4 becomes deep, a damage may also occur to the fuser belt 11 in contact with the driven ring 4.

FIG. 14A is a schematic diagram showing a contact state of the fuser belt 11, the driven ring 4, and the abutting face 32*a* in this embodiment. In this embodiment, as mentioned above, the central axis A of an arc formed by the contact face 31*a* of the belt supporting part 31 and the central axis B of an arc formed by the bottom face 33*a* of the ring supporting groove 33 are shifted.

The fuser belt 11 rotates centering on the central axis A. On the other hand, if there is a speed difference between the rotation speed of the fuser belt 11 and the rotation speed of the driven ring 4, the driven ring 4 rotates centering on the central axis B. That is, the center of rotation of the fuser belt 11 and the center of rotation of the driven ring 4 differ. Therefore, the fuser belt 11 cannot continue to contact with the surface of the driven ring 4 in the same radial position. That is, the contact region with the fuser belt 11 on the surface of the driven ring 4 (that is, the first contact face 41 shown in FIG. 8) becomes a wide region ranging from the inner circumferential vicinity to the outer circumferential vicinity of the driven ring 4.

FIG. 14B is a schematic diagram showing a state that a groove 4*b* has occurred on the driven ring 4 in this embodiment. FIG. 14C is a schematic diagram showing an example of the surface roughness distribution of a part indicated with a code E in FIG. 14B. In FIG. 14C, the vertical axis indicates the radial position (R), and the horizontal axis the surface roughness. As mentioned above, because the contact region with the fuser belt 11 on the surface of the driven ring 4 becomes a wide region ranging from the inner circumferential vicinity to the outer circumferential vicinity of the driven ring 4, the range where the surface of the driven ring 4 is shaved off becomes large. Even if a groove 4*b* is formed on the surface of the driven ring 4, its depth becomes small. Therefore, a damage to the driven ring 4 can be suppressed, and a damage to the fuser belt 11 in contact with this driven ring 4 can also be suppressed.

Also, as mentioned above, if the inner diameter of the fuser belt 11 is set to 30 mm and the inner diameter of the driven ring 4 to 29.2 mm, the distance S between the central axis A and the central axis B should desirably be 0.4 mm or less. If the distance S between the central axis A and the central axis B is one half or less of the inner diameter of the fuser belt 11 minus the inner diameter of the driven ring 4 (0.8 mm here), the fuser belt 11 would never be dislocated from the inner circumferential side of the driven ring 4.

<Efficacy of Embodiment>

As explained above, in this embodiment, the belt supporting part 31 is in contact with the fuser belt 11 on the contact face 31*a* shaped in an arc centering on the central axis A (first central axis), the ring supporting groove 33 is in contact with the driven ring 4 on the bottom face 33*a* shaped in an arc centering on the central axis B (second central axis), and these central axes A and B are shifted from each other. Therefore, the center of rotation of the fuser belt 11 and the center of rotation of the driven ring 4 can be made different. As a result, the contact region with the fuser belt 11 on the surface of the driven ring 4 expands, thereby the formation of a deep groove on the surface of the driven ring 4 can be prevented. Thereby, a damage to the driven ring 4 can be prevented, and a damage to the fuser belt 11 in contact with the driven ring 4 can also be prevented.

Also, because the radial width H of the driven ring 4 is larger than the distance S between the central axis A and the central axis B, even if the fuser belt 11 rotates centering on the central axis A and the driven ring 4 rotates centering on the central axis B, the contact state between the fuser belt 11 and the driven ring 4 can be secured.

Also, because the belt supporting part 31 and the ring supporting groove 33 are formed on the common flange member 3 (supporting body), the fuser belt 11 and the driven ring 4 can be supported by the contact face 31*a* and the bottom face 33*a* in a simple configuration.

Also, because the ring supporting groove 33 is formed adjacent to the belt supporting part 31 in the width direction (Y direction) of the fuser belt 11, the driven ring 4 can be supported so as to contact with an end face of the fuser belt 11.

Also, because the depth D of the ring supporting groove 33 varies along the circumferential direction, a configuration that the central axis A and the central axis B are shifted can be realized in a simple configuration.

Also, because the flange member 3 (supporting body) has the abutting face 32*a* that can contact with the driven ring 4 on the opposite side of the belt supporting part 31 with respect to the ring supporting groove 33, it can contact with the driven ring 4 displaced by contacting with the fuser belt 11 and regulate the width-direction position of the fuser belt 11.

Also, having the heat diffusing member 16 between the heater 15 and the fuser belt 11 and holding the heater 15 between the heater supporting member 13 and the heat diffusing member 16, heat of the heater 15 can be efficiently transmitted to the fuser belt 11.

Also, because the tapered face 32*b* is formed adjacent to the lower part of the abutting face 32*a*, if the fuser belt 11 is displaced in the Y direction when it passed through the lower part of the belt supporting part 31 (the part where the opening part 31*c* is formed) and contacted with the contact face 31*a*, the driven ring 4 is allowed to bend, and the bending of the driven ring 4 can be released by the tapered face 32*b*.

Note that although the belt supporting part 31, the ring supporting groove 33, and the connecting part 32 were formed on the common flange member 3 (supporting body) in the above-mentioned embodiment, these can be formed as separate bodies.

Also, although the pressure application roller 2 as a pressure application member was installed on the outer circumferential side of the fuser belt 11 in the above-mentioned embodiment, instead of the pressure application roller 2, a pressure application pad may be installed for example.

Although the stay 12, the heater supporting member 13, the heat conducting member 14, the heater 15, the heat diffusing member 16, and the temperature sensor 17 were installed on the inner circumferential side of the fuser belt 11 in the above-mentioned embodiment, this invention is not limited to such a configuration as this, but its configuration only needs to allow heating the fuser belt 11 by the heater 15 from the inner circumferential side.

Although an image forming apparatus that forms a color image was explained in the above-mentioned embodiment, this invention can also be applied to an image forming apparatus that forms a monochromatic image. Also, this invention can be utilized, for example, by image forming apparatuses (such as copiers, facsimile machines, printers, and multifunction peripherals) that form an image on a medium using an electrophotographic system and their fuser devices.

What is claimed is:

1. A fuser device for fusing a developer image on a medium by applying heat, comprising:

an endless fuser belt, a belt supporting part that has a first contact face shaped in an arc that is contact with an inner circumferential face of the fuser belt, and a first central position that is a center of the first contact face shaped in the arc, a driven ring that is disposed on at least one side of the fuser belt in the width direction of the fuser belt, and a ring supporting part that has a second contact face shaped in an arc that is contact with an inner circumferential face of the driven ring, a second central position that is a center of the second contact face shaped in the arc, wherein the first central position is shifted from the second central position.

2. The fuser device according to claim 1, wherein the driven ring has a width in a radial direction, and the width of the driven ring is larger than a distance between the first central position and the second central position.

3. The fuser device according to claim 1, wherein the belt supporting part and the ring supporting part are formed on a common supporting body.

4. The fuser device according to claim 3, wherein the ring supporting part is a groove part formed adjacent to the belt supporting part in the width direction of the fuser belt.

5. The fuser device according to claim 1, wherein an abutting face that can contact with the driven ring is provided on an opposite side of the belt supporting part with respect to the ring supporting part.

6. The fuser device according to claim 1, further comprising:

a tapered face that can contact with the driven ring and inclines relative to the width direction on the opposite side of the opening part of the belt supporting part with respect to the ring supporting part.

7. The fuser device according to claim 1, wherein the distance between the first central position and the second central position is one half or less of a value that is obtained by subtracting the inner diameter of the fuser belt from the inner diameter of the driven ring.

8. The fuser device according to claim 1, wherein the driven ring can bend in a thickness direction.

9. The fuser device according to claim 1, wherein the fuser belt has a base layer formed of metal, and the driven ring is formed of resin.

10. The fuser device according to claim 1, wherein a pressure application member that forms a nip section that is formed between the pressure application member and the fuser belt is disposed on an outer circumferential side of the fuser belt.

11. An image forming apparatus, comprising:

an image forming part that forms a developer image on a medium using a developer, and the fuser device according to claim 1 that fuses the developer image formed by the image forming part to the medium.

12. The fuser device according to claim 1, wherein a ring supporting part is a groove part having a different depth in a circumferential direction.

13. A fuser device for fusing a developer image on a medium by applying heat, comprising:

an endless fuser belt, a belt supporting part that has a first contact face shaped in an arc that is contact with an inner circumferential face of the fuser belt, and a first central position that is a center of the first contact face shaped in the arc, a driven ring that is disposed on at least one side of the fuser belt in the width direction of the fuser belt, and a ring supporting part that has a second contact face shaped in an arc that is contact with an inner circumferential face of the driven ring, a second central position that is a center of the second contact face shaped in the arc, wherein the first central position is shifted from the second central position, the ring supporting part is a groove part formed adjacent to the belt supporting part in the with direction of the fuser belt, and the depth of the groove part varies along a circumferential direction.

14. A fuser device for fusing a developer image on a medium by applying heat, comprising:

an endless fuser belt that is flexible and has a width in a belt axis, the width being determined by a pair of edges in an axis direction along the belt axis wherein the fuser belt has an inner circumferential face and an outer circumferential face that are opposed in a radial direction perpendicular to the axis direction, a pair of belt supporting parts each of which has a first contact face shaped in an arc centering on a first central axis, wherein the first central axis being a virtual line extending parallel to the axis direction, wherein the first contact face is inserted inside the fuser belt from one of the edges such that the first contact face supports the inner circumferential face of the fuser belt to rotate around the first central axis, a driven ring that has a ring shape, wherein the driven ring has an inner radial, an outer radial, an inside face that is determined by a difference between the inner radial and the outer radial in the radial direction, and the inside face is disposed to face one of the edges of the fuser belt, a ring supporting part that has a second contact face shaped in an arc centering on a second central axis, wherein the second central axis being a virtual line extending parallel to the first central axis, wherein the second contact face has a supporting radial in the radial direction from the second central axis, wherein the supporting radial of the ring supporting part is smaller than the inner radial of the driven ring such that the driven ring rotates around the second central axis as contacting the second contact face of the ring supporting part, wherein a gap distance, which is defined between the first central axis and the second central axis seen from a view of the belt axis, the inner and outer radials of the driven ring are set such that the inside face of the driven ring is always in contact with the one of the edges of the fuser belt while the fuser belt rotates around the first central axis.

15. The fuser device according to claim 14, wherein assuming that a radial of the first contact face, which is in the radial direction from the first central axis, is L1, the supporting radial of the second contact face is L2, and the gap distance is S, these L1, L2 and S are ranged to satisfy:

$$0.25 \leq S/(L1-L2) \leq 1.0.$$

16. The fuser device according to claim 15, wherein assuming that the arc of the first contact face around the first central axis is θ1, and the arc of the second contact face around the second central axis is θ2, these arcs are ranged to satisfy:

$$210° \leq \theta 1 \leq 225°$$

$$210° \leq \theta 2 \leq 225°.$$

* * * * *